US006962333B2

(12) United States Patent
Mizuno et al.

(10) Patent No.: US 6,962,333 B2
(45) Date of Patent: Nov. 8, 2005

(54) ROLLER AND SHEET DELIVERY UNIT

(75) Inventors: Sho Mizuno, Otsu (JP); Hideyuki Sawayama, Omihachiman (JP)

(73) Assignee: Omron Corporation, Kyoto-fu (JP)

( * ) Notice: Subject to any disclaimer, the term of this patent is extended or adjusted under 35 U.S.C. 154(b) by 387 days.

(21) Appl. No.: 10/391,752

(22) Filed: Mar. 20, 2003

(65) Prior Publication Data

US 2003/0218293 A1 Nov. 27, 2003

(30) Foreign Application Priority Data

Mar. 20, 2002 (JP) ..... 2002-078776
Feb. 27, 2003 (JP) ..... 2003-051186

(51) Int. Cl.[7] ..... B65H 3/06

(52) U.S. Cl. ..... 271/109; 271/122; 271/125; 492/49; 492/39

(58) Field of Search ..... 271/109, 122, 271/125; 492/49, 39, 42, 43, 44

(56) References Cited

U.S. PATENT DOCUMENTS 5,660,489 A * 8/1997 Ishii et al. ..... 400/641
5,725,209 A * 3/1998 Takahashi et al. ..... 271/122
6,038,424 A * 3/2000 Nakagawa ..... 399/367

FOREIGN PATENT DOCUMENTS

JP 6-329282 A * 11/1994
JP 6-340343 A * 12/1994
JP 7-117880 A * 5/1995
JP 10-316257 A * 12/1998

* cited by examiner

*Primary Examiner*—David H. Bollinger
(74) *Attorney, Agent, or Firm*—Dickstein Shapiro Morin & Oshinsky LLP

(57) ABSTRACT

The invention provides a roller having excellent flexibility and wear resistance. The invention also provides a sheet delivery unit equipped with this roller. The unit is prevented from being clogged up with sheets due to rigidities of the sheets. Also, simultaneous delivery of plural sheets is suppressed. The allowable range of rigidities of paper currencies and the allowable range of their widths can be extended. The roller has a central portion extending along an axis, an outer peripheral portion formed around the central portion and made of a resilient body, and plural helical ribs connecting together the central portion and the outer peripheral portion. Each rib consists of a resilient body. Each rib is so shaped as to thicken gradually from the central portion toward the outer peripheral portion.

7 Claims, 6 Drawing Sheets

ROLLER AND SHEET DELIVERY UNIT

FIELD OF THE INVENTION

The present invention relates to a roller used to deliver sheets of paper one by one from a stack and also to a sheet delivery unit using this roller.

BACKGROUND OF THE INVENTION

One known sheet delivery unit utilizes the overlap method as described in Japanese Patent JP-A-2000-203735 to deliver sheets one by one out of a stack of paper. Another known sheet delivery unit makes use of the retard method described in Japanese Patent JP-A-8-81079 for the same purpose.

In the overlap method, a feed roller rotated at a feeding force to deliver sheets of paper and a gate roller that is brought to a standstill during delivery are made to overlap. A force is produced when sheets of paper are squeezed between the feed and gate rollers and become deformed wavily. Using this force, frictional force is produced between each sheet and the rollers. Thus, the sheets are separated one by one.

The "overlap" means that where the feed roller has two grooves, for example, on its outer surface, with the grooves extending in the direction of rotation, the feed and gate rollers are subtly made to overlap each other such that the outer surface of the gate roller slightly enters the grooves.

In the overlap method of JP-A-8-81079, however, strict accuracy is imposed on the amount of overlap between the rollers. Therefore, accurate rollers are necessitated. For example, where thick sheets of paper are used during a process where paper sheet processing equipment is fabricated, there is the drawback that the amount of overlap needs to be readjusted.

For example, where paper currencies of different thicknesses are treated, separate adjustments are necessary because the thicknesses of paper currencies are different among different nations. To separate the currencies, the amount of overlap must be finely adjusted for each currency thickness.

Furthermore, where a sheet of paper breaks and stays within a sheet delivery unit, if one tries to deliver the sheet, the unit may be clogged up because of increased thickness of the stacked sheets. In this case, automatic delivery cannot be done and the currency fragments must be removed manually.

Furthermore, where a sheet of paper of low rigidity is delivered, it is considered that this sheet is delivered together with following sheets in a stacked form. For example, new paper currencies have higher rigidity and so the amount of overlap is adjusted according to the new currencies. In this case, the ability to separate old currencies, which have been greatly deteriorated due to circulation and have reduced rigidity, (i.e. easily deformed wavily) is reduced greatly.

In the retard method of JP-A-8-81079, a retard roller is made of a softer rubber than the feed roller. During delivery, if a plurality of sheets of paper are fed in, the nip portion (contact portion) of the retard roller is deformed into a concave shape. The front ends of all sheets fed in are brought into direct contact with the retard roller to thereby separate the sheets. That is, the method is intended to concavely deform the nip portion of the retard roller. Therefore, this method is effective for separation of sheets of one kind. However, where sheets of different thicknesses or rigidities are treated, it is impossible to obtain stable separating action over all sheets of paper due to deformation.

BRIEF SUMMARY OF THE INVENTION

The present invention provides a roller having excellent wear resistance.

Furthermore, the invention provides a sheet delivery unit equipped with this roller.

In addition, the invention provides a method of delivering sheets of paper without being affected by thicknesses or rigidities of the sheets to be conveyed. That is, it is another object of the invention to convey sheets of paper reliably if they are not uniform in thickness.

This invention provides a roller having a central portion extending along an axis, an outer peripheral portion formed around the central portion and made of a resilient body, and plural ribs connecting together the central portion and the outer peripheral portion. Each rib is made of a resilient body. This roller is characterized in that the ribs are so shaped as to thicken gradually from the central portion to the outer peripheral portion.

This invention also provides a sheet delivery unit having a feed roller for delivering sheets of paper by rotating, a gate roller for separating the sheets from a stack of paper, disk-like protruding portions formed on the outer surface of the feed roller, other disk-like protruding portions formed on the outer surface of the gate roller, and contact portions formed on the protruding portions. The contact portions of the feed and gate rollers are made to overlap each other. The sheet delivery unit separates the sheets one by one along the outer surfaces of the rollers and delivers them. At least one of the feed and gate rollers has a central portion extending along an axis and a connector portion formed around the central portion. The connector portion has a plurality of helical ribs each made of a resilient body. The connector portion is provided with a plurality of helical hollow cavities from the central portion to the outer peripheral portion. Each of the cavities thins gradually from the central portion to the outer peripheral portion.

As one form of the above-described sheet delivery unit, the helical direction directed from the axis of each rib toward the outer peripheral portion in the roller can be set in the counter clockwise direction so that the rib is pushed backward in the presence of a load (e.g. sheets of paper) received by the outer peripheral portion at the intersection of the outer peripheral portion and each conveyed sheet during delivery of the sheets.

When the roller of the present invention receives force directed from the outer peripheral portion of the roller toward the axis, those portions of the ribs and cavities which are closer to the axis are deformed. The outer peripheral portion can be displaced toward the center axis without deforming the outer peripheral portion itself.

The roller can be made of a frictional material such as hard or soft rubber. The profile of the roller can take the form of a disk.

According to the above-described sheet delivery unit of the invention, during delivery of sheets of paper, when at least one of the feed and gate rollers constructed as mentioned previously comes into contact with a sheet, those portions of the ribs and cavities in the roller which are closer to the axis deform due to the delivery load (sheet-conveying load). The portion of the outer peripheral portion that touches the sheet can be displaced toward the center axis such that this peripheral portion itself hardly deforms.

The aforementioned sheets of paper include paper currencies, checks, securities, sheets of printed matter, sheets of paper, and combinations thereof.

According to the roller of this invention, when it receives force directed from the outer peripheral portion toward the axis, those portions of the ribs which are closer to the axis are deformed. The outer peripheral portion is displaced toward the axis without deforming the outer peripheral portion itself. Therefore, displacement of the outer peripheral portion is permitted while securing friction force on the outer peripheral portion.

Furthermore, if a very hard member is used in the outer peripheral portion, the required displacement of the outer peripheral portion is obtained. As a result, a roller having excellent flexibility and wear resistance can be derived.

According to the sheet delivery unit of this invention, delivery of sheets of paper can be carried out reliably. It can also treat various kinds of sheets of paper ranging widely in rigidity and thickness.

DETAILED DESCRIPTION OF THE INVENTION

Embodiments of this invention are hereinafter described with reference to the drawings.

Figure 1:
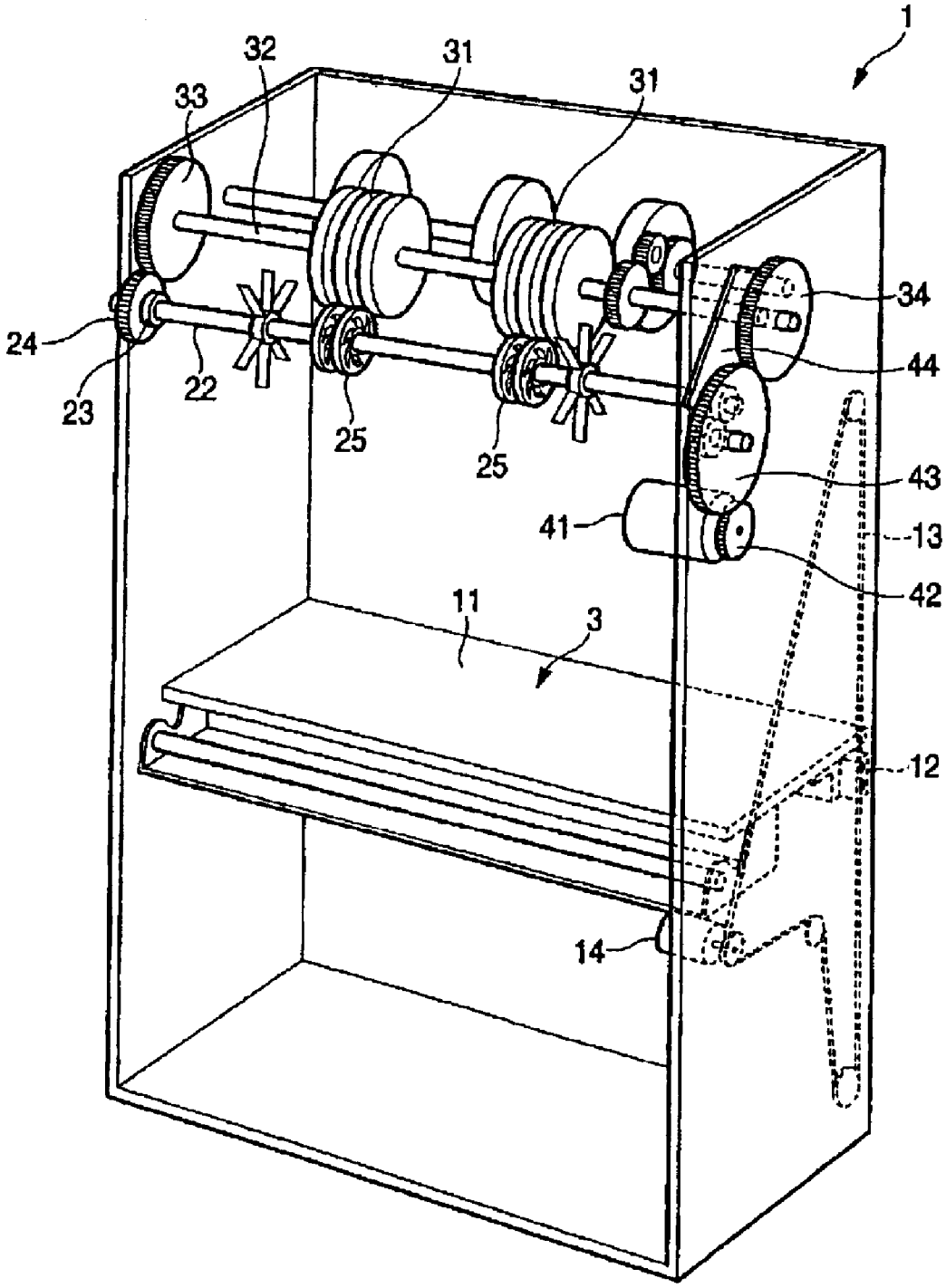
FIG. 1 is a perspective view of a paper currency collecting-and-delivering device according to the present invention.
Figure 2:
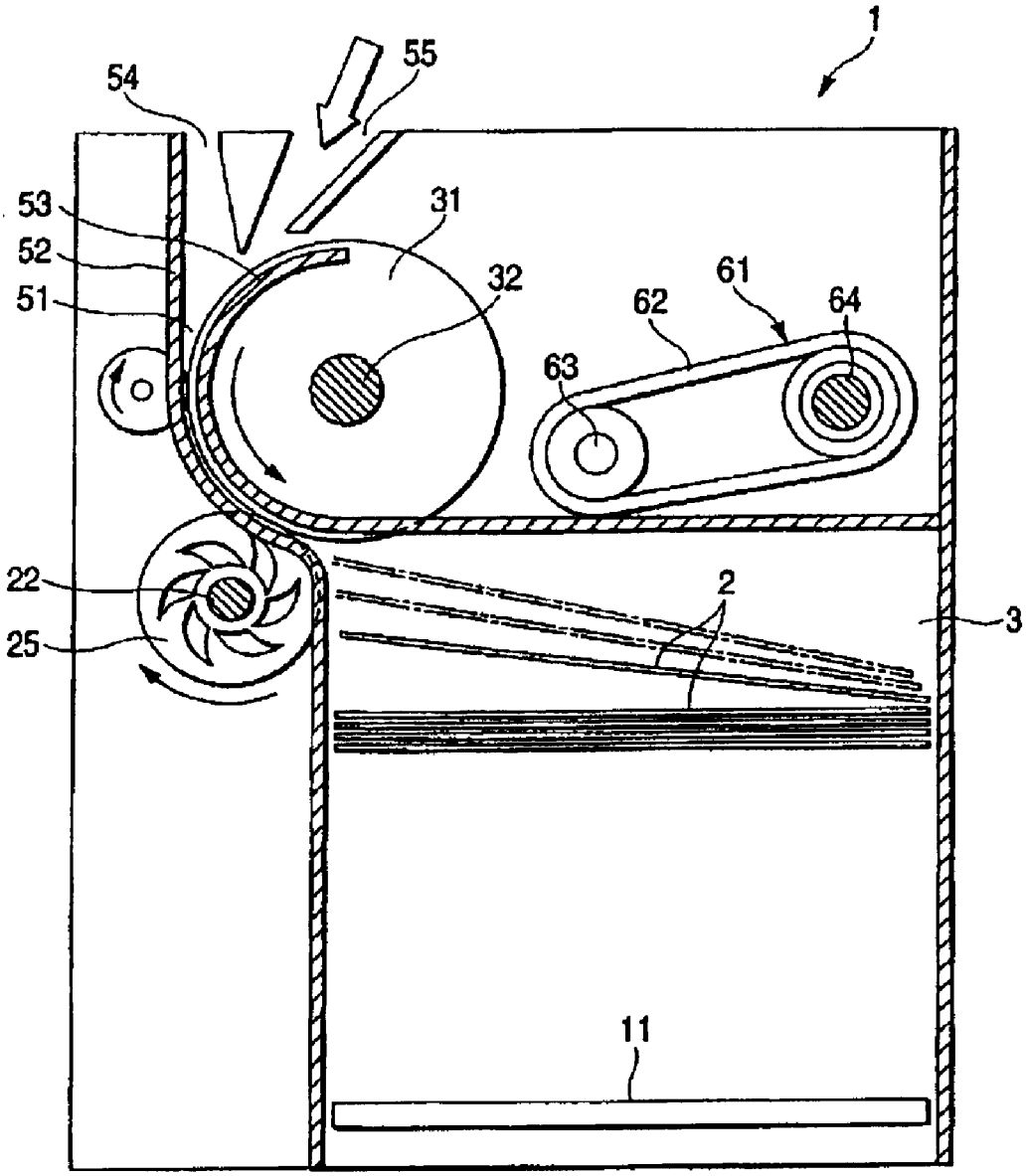
FIG. 2 is a right side elevation in cross section of the paper currency collecting-and-delivering device.

The perspective and structure of a paper currency collecting-and-delivering device 1 is first described by referring to FIGS. 1 and 2.

FIG. 1 is a perspective view of the paper currency collecting-and-delivering device 1. The contour of this device 1 is shaped like a box. The device 1 has an inner collection space 3 where paper currencies are stacked and collected. An elevating plate 11 having the same size as the currencies is mounted at the bottom of the collection space 3.

The elevating plate 11 is so guided that it can move up and down in a horizontal state. The elevating plate 11 is controllably moved up and down by rotating an elevating belt 13 forward and rearward by rotating force of a reversible motor 14, the belt 13 being firmly mounted at a firm mounting portion 12.

Cylindrical feed rollers 31 for conveying paper currencies in the direction of delivery or collection are rigidly mounted to a feed shaft 32 in a top portion of the paper currency collecting-and-delivering device 1. The feed shaft 32 extends laterally and is supported. Each feed roller 31 is made of a quite hard rubber material that is a highly frictional and quite hard member.

A toothed wheel 34 is firmly secured to the right end of the feed shaft 32. Another toothed wheel 43 is in mesh with the toothed wheel 34. Rotating force of the reversible motor 41 is transmitted via the toothed wheel 43 and via a toothed wheel 42 firmly affixed to the reversible motor 41. Thus, the feed shaft 32 is rotationally driven.

A toothed wheel 33 is rigidly mounted to the left end of the feed shaft 32. Power is transmitted via a toothed wheel 24 to a gate shaft 22 that is mounted ahead of and below the feed shaft 32 and supported.

The toothed wheel 24 is fitted at the left end of the gate shaft 22. A one-way clutch 23 (not shown) is mounted inside the toothed wheel 24. The one-way clutch 23 rotates the gate shaft 22 forwardly during operation for collecting paper currencies and prevents the gate shaft 22 from being rotated reversely by the driving force of the reversible motor 41 during operation for delivering paper currencies.

Another one-way clutch 23 for preventing rotation during operation for delivering currencies is mounted at the right side of the toothed wheel 24. During operation for collecting currencies, this clutch permits forward rotation of the gate shaft 22 but locks the gate shaft 22 during delivery against reverse rotation due to a feed roller 31 (described below). These two one-way clutches 23 assure forward rotation of the gate shaft 22 during collection and non-rotation, or locking, of the gate shaft 22 during delivery.

Gate rollers 25 are made of a hard rubber material that is a highly frictional and quite hard material. The gate rollers 25 are constructed as a flexible structure as described below. These gate rollers 25 are firmly mounted to the gate shaft 22 and placed opposite to the feed roller 31. Plural protrusions formed on the outer surfaces of the rollers are kept overlapping each other.

The right end of the gate shaft 22 is supported to a positioning plate 44 outside the collection space 3. The feed shaft 32 is similarly supported to the positioning plate 44 and thus the right end is placed in position along with the feed shaft 32.

A belt driving portion 61 having a pulley 64 around which a belt 62 is stretched is mounted behind the feed roller 31 as shown in the right side elevation in cross section of FIG. 2. The belt driving portion 61 swings up and down about the deeper pulley 64 during collection and also during delivery. During delivery, the belt driving portion touches collected paper currencies 2 and delivers them in the direction of delivery. During collection, the belt driving portion swings upward about the deeper pulley and thus does not touch the collected currencies 2.

A conveyance path 51 for conveying paper currencies is composed of guide plates 52 and 53. The guide plate 53 guides the top side, inner side, and bottom side of each currency at a position slightly inside the outer surface of the feed roller 31 and extends directly rearward horizontally. The guide plate 52 extends exactly downward from a currency delivery port 54 located ahead of the top end of the collecting-and-delivering device 1. A part of the guide plate 52 is curved along the outer surface of the feed roller 31. Then, the guide plate 52 again extends exactly downward.

A currency insertion port 55 is formed slightly behind the currency delivery port 54. The insertion port 55 and currency delivery port 54 are merged inside and in communication with the conveyance path 51.

Because of the configuration and structure described thus far, during collection, the feed roller 31 rotates in the direction of collection (counterclockwise) as shown in FIG. 2. A paper currency 2 conveyed in from the currency insertion port 55 receives conveying force of the feed roller 31 and is conveyed through the conveyance path 51. Then, it is released into the collection space 3 and collected onto the elevating plate 11.

Figure 3:
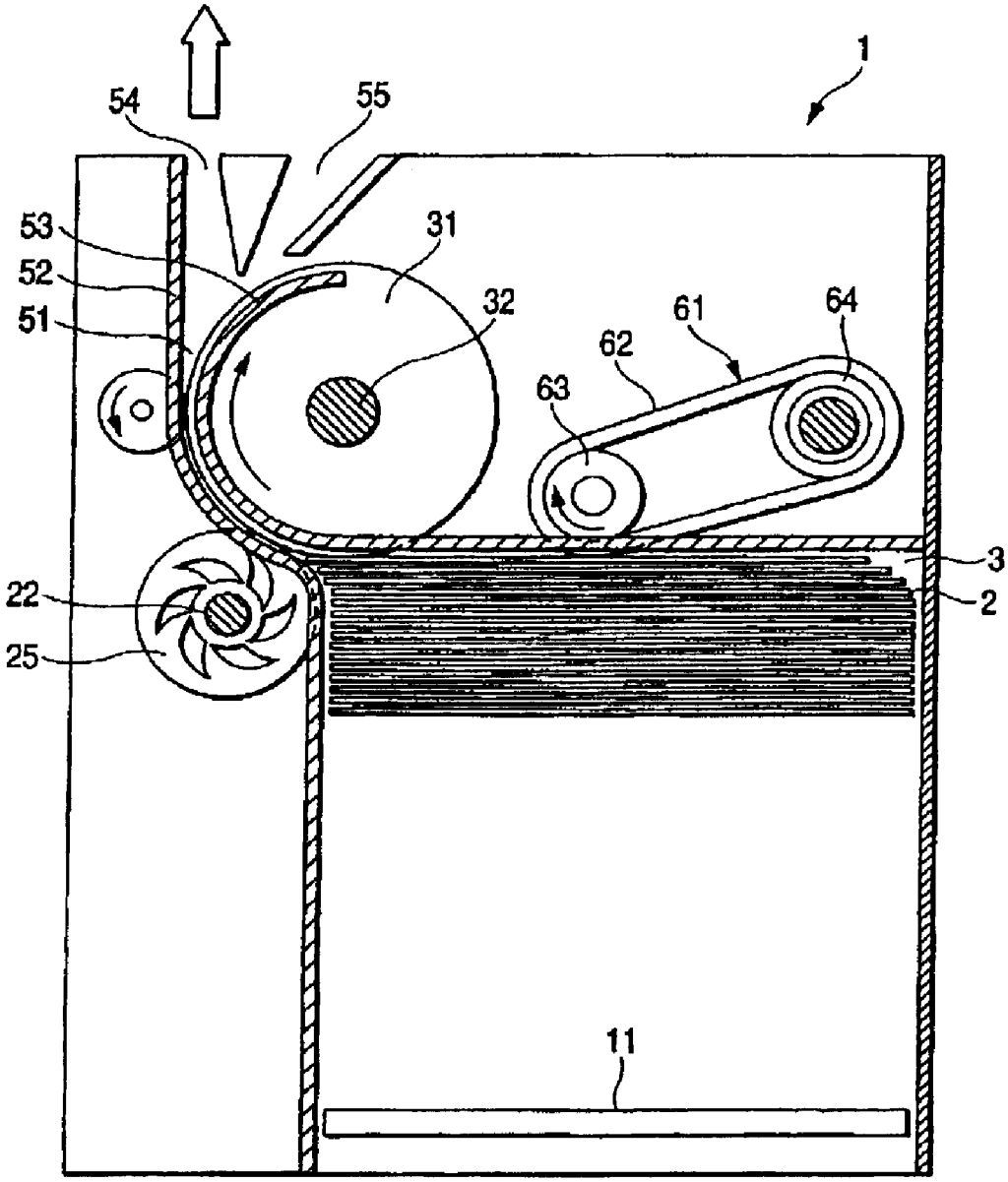
FIG. 3 is a right side elevation in cross section of the paper currency collecting-and-delivering device.

During delivery, the feed roller 31 rotates in the direction of delivery (clockwise) as illustrated in FIG. 3. The currency 2 picked up by the belt driving portion 61 receives conveyance control of the feed roller 31 and single sheet delivery control of the gate roller 25 of the flexible structure. The currency is conveyed back through the conveyance path 51 and delivered from the currency delivery port 54.

FIG. 3 is a right side elevation in cross section during delivery operation. As shown, the belt driving portion 61 is suspended. Flatly stacked paper currencies 2 are picked up and sent out into the conveyance path 51.

At this time, the direction of rotation of the feed roller 31 is reversed as compared with during collection. The two one-way clutches 23 described already in connection with FIG. 1 do not permit rotation of the gate shaft 22. The gate roller 25 firmly fixed to the gate shaft 22 is also not permitted to rotate.

The second and subsequent paper currencies 2 that would otherwise be sent out together with the first currency 2 by the belt driving portion 61 are fastened by the frictional force of the gate roller 25.

The currency 2 sent onto the conveyance path 51 is sent out upward by the feed roller 31 and delivered from the currency delivery port 54.

As a result of the delivery operation described above, the paper currencies are separated one by one and delivered by the gate roller 25. At this time, if the rigidities of the currencies 2 are different, the amount of displacement of the gate roller 25 varies flexibly according to the rigidity of each currency 2 because of the resilience of the flexible structure of the gate roller 25.

The flexible structure of the gate roller 25 is described next by referring to the perspective view of FIG. 4A. The state during delivery operation is described by referring to FIGS. 5 and 6 that illustrate the operation.

The gate roller 25 is cylindrical and has the gate shaft 22 shown in FIG. 1 passing through the center. The roller 25 is provided with helical holes extending vertically to the side surface.

Its outer peripheral portion 25*a* and central portion 25*c* are connected by six ribs 25*b*. The ribs 25*b* are so shaped that their portions closer to the central portion 25*c* are thinner and that the ribs thicken toward the outer peripheral portion 25*a*.

The aforementioned ribs 25*b* are each shaped helically. The helical direction from the central portion 25*c* to the outer peripheral portion 25*a* is set to the counterclockwise direction as shown in FIG. 4A. In particular, during operation for delivering paper currencies 2 as shown in FIG. 3, in the presence of load (force received from the conveyance direction x) in carrying the paper currencies 2, the ribs 25*b* opposite to the currencies are pushed backward, as illustrated in FIGS. 6B and 6C, at the intersection y of the outer peripheral portion 25*a* and each currency 2 conveyed in the direction of conveyance x as shown in FIG. 4A.

The outer peripheral portion 25*a*, six ribs 25*b*, and central portion 25*c* are molded integrally from a hard rubber material. The gaps between the ribs 25*b* are shaped into helical cavities 25*d* that gradually thin from the central portion 25*c* toward the outer peripheral portion 25*a*.

Figure 4A:
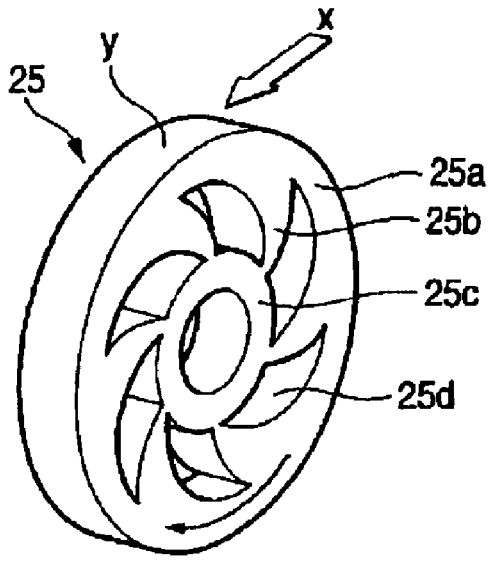
FIG. 4 is a schematic perspective view of a gate roller.

The helical direction from the central portion 25*c* of each cavity 25*d* toward the outer peripheral portion 25*a* is set to counterclockwise direction as shown in FIG. 4A in the same way as the ribs 25*b*. That is, during operation for delivering paper currencies 2 as shown in FIG. 3, in the presence of load in carrying the currencies 2 (force received from the direction of conveyance x), the ribs opposite to them are pushed and moved back in the counter clockwise direction as illustrated in FIGS. 6B and 6C. Each cavity is so shaped as to thin gradually from the central portion 25*c* toward the outer peripheral portion 25*a*.

Because of the structure described thus far, when the gate roller 25 receives the force of load in conveying each currency 2 from the outer surface toward the center axis, the ribs 25*b* are pushed backward in the portions where the ribs 25*b* opposite to the currency are thinned. The ribs are deformed in the counterclockwise direction. The outer peripheral portion 25*a* can be displaced toward the center axis such that the peripheral portion 25*a* itself hardly deforms.

Since the gate roller 25 has a large width, the end of the rib 25*b* on the center axis side does not deform at an angle to the direction of the center axis. The outer peripheral portion 25*a* is displaced straight toward the center axis.

Figure 4B:
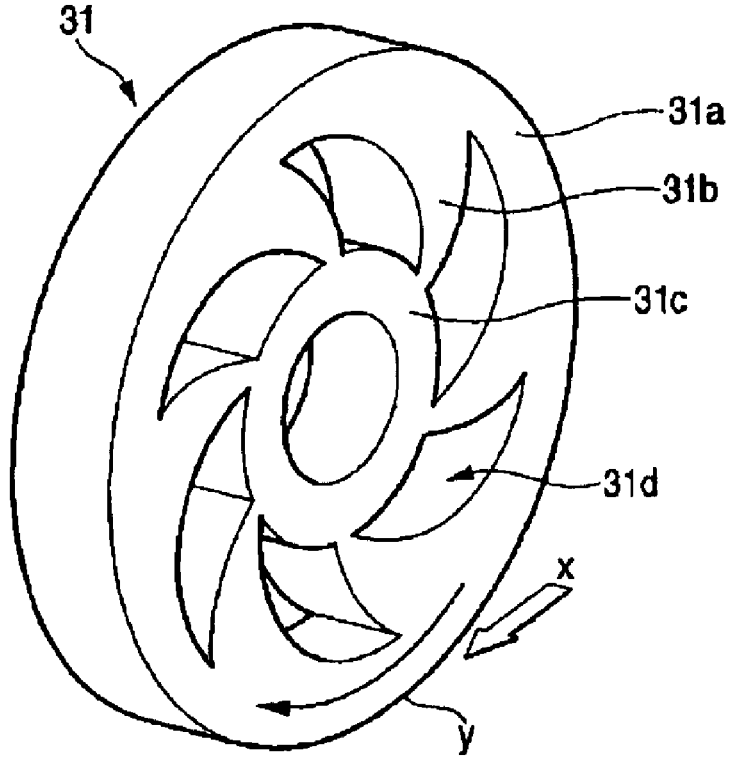

FIG. 4B shows an example in which a flexible structure similar to that of the gate roller 25 is adopted in the feed roller 31. This example will be described in detail below.

Figure 5A:
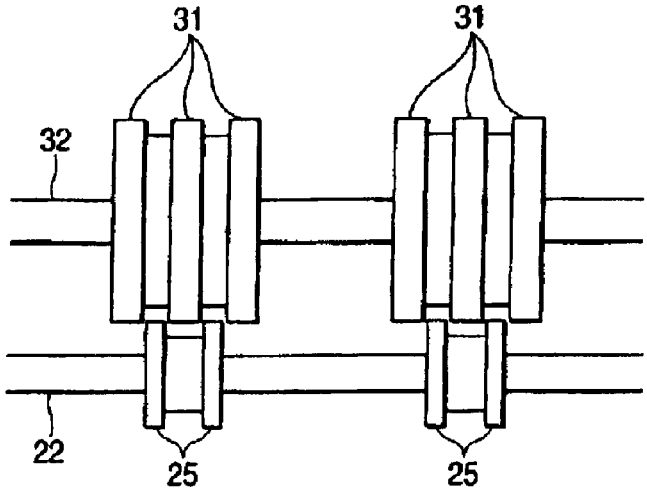
FIG. 5 is a view illustrating the operation of sheets of paper delivered.
Figure 6A:
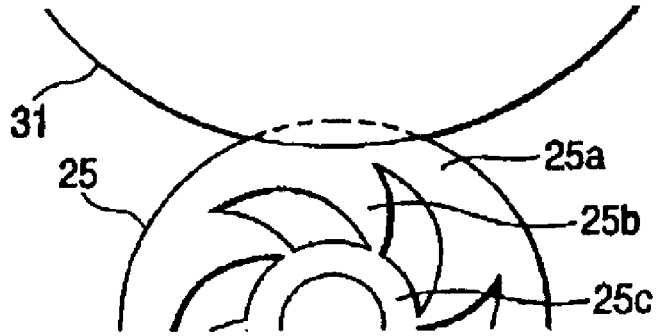
FIG. 6 is a view illustrating the operation of sheets of paper delivered.
Figure 6B:
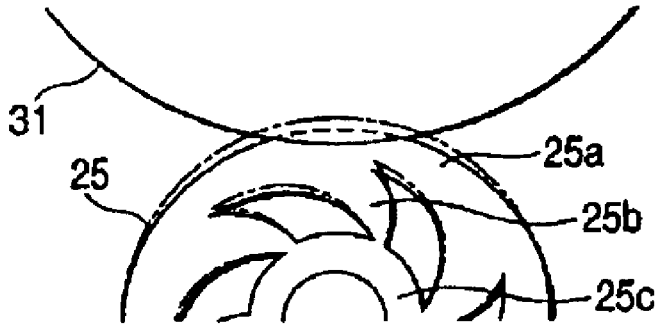
Figure 6C:
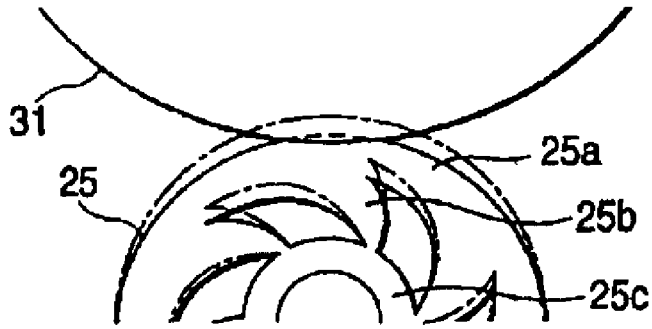

The gate roller 25 of the above-described structure does not deform as shown in the right side elevation of FIG. 6A in a normal state, i.e., before paper currency 2 is inserted between each feed roller 31 and the gate roller 25 as shown in FIG. 5A. That is, the gate roller is in its normal state.

Figure 5B:
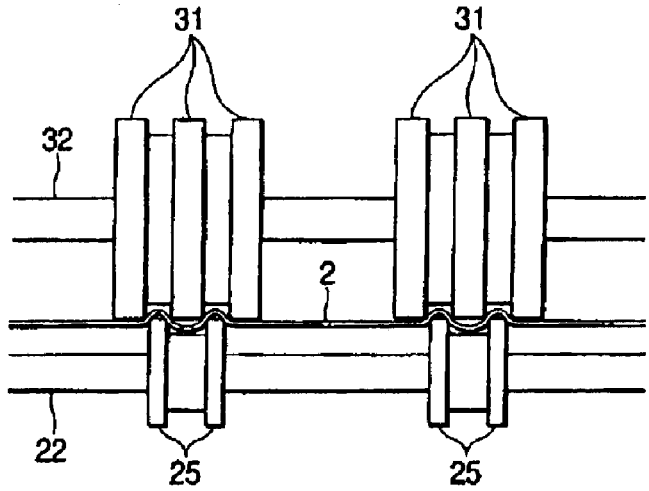

With respect to the feed rollers 31 shown in FIG. 5A, three feed rollers are used as a set as shown. With respect to the gate rollers 25, two gate rollers are similarly used as a set. The outer surfaces of the two gate rollers 25 slightly enter the gaps between the three successive feed rollers 31 such that the sets of rollers 31, 25 overlap. As shown in FIG. 5B, paper currencies 2 are deformed into an M-shaped form as viewed in a plane and delivered or collected.

Figure 5C:
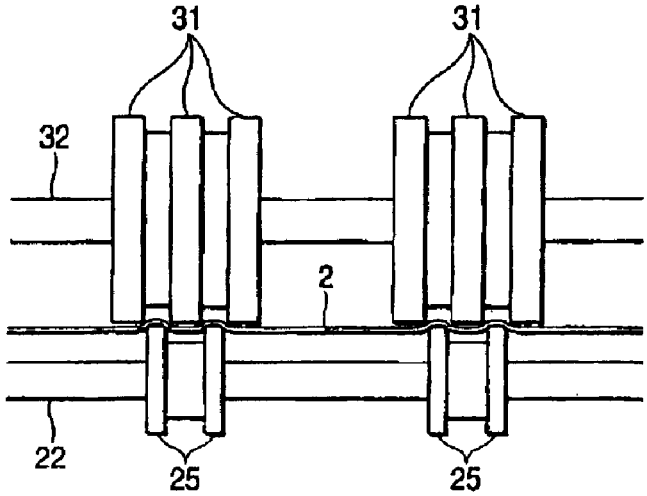

If a paper currency 2 of low rigidity (e.g., an old paper currency) is inserted here, the currency 2 is greatly deformed wavily as shown in FIG. 5B. Each gate roller 25 slightly deforms (shrinks) toward the center axis as shown in FIG. 6B. The outer peripheral portion 25*a* with which the currency 2 comes into contact moves slightly toward the center axis. Thus, where the paper currency 2 of low rigidity is delivered, the sufficient amount of overlap provides the frictional force necessary to prevent simultaneous delivery of plural paper currencies 2.

Where a paper currency 2 of high rigidity (e.g., a new paper currency) is inserted, it is slightly deformed wavily as shown in FIG. 5C. Each gate roller 25 greatly deforms (shrinks) toward the center axis as shown in FIG. 6C. The outer peripheral portion 25*a* with which the paper currency 2 comes into contact moves a large distance toward the center axis.

As the amount of change of the paper currency proportional to the amount of overlap increases, the restoring force that brings the currency back to its original state is increased. Therefore, it is considered that for the same amount of overlap, larger frictional force is produced when paper currency 2 of higher rigidity is delivered than when paper currency 2 of lower rigidity is delivered.

Therefore, when the paper currency 2 of higher rigidity is delivered, the amount of overlap is reduced by deformation of the gate rollers 25 as described above. This reduces the frictional force. Frictional force necessary to prevent simultaneous delivery of plural paper currencies is obtained and, at the same time, the phenomenon that paper currency 2 cannot deform fully can be prevented; otherwise, the unit would be clogged up.

Thus, the contact surface of the outer peripheral portion 25*a* of each gate roller 25 that comes into contact with the paper currency 2 can be displaced toward the center axis by the contact load dependent on the amount of overlap with each feed roller 31 and also on the rigidity of the paper currency 2 while substantially maintaining the curvature of the outer periphery of the gate roller 25. Consequently, simultaneous delivery of plural paper currencies 2 can be prevented by stable frictional force, irrespective of the value of the angle at which each currency 2 enters the intersection y of each gate roller 25 and the currency 2. In this way, a single paper currency can be delivered. The allowable range of rigidities of paper currencies 2 and the allowable range of their widths can be set wide.

More specifically, in the past, where a setup is made according to paper currency 2 of low rigidity as shown in FIGS. 5A and 6A, if one attempts to deliver paper currency 2 of high rigidity as shown in FIG. 5C, the necessary displacement toward the center axis is not obtained. The result is that the unit is clogged up with the currency 2. However, in the present invention, the amount of displacement is increased by the helical cavities 25*d*. Therefore, it is possible to cope with paper currencies 2 of different rigidities in this way.

The use of the gate rollers 25 having high hardness, high friction, and high resilience in this way permits the outer peripheral portion 25*a* of each gate roller 25 to be naturally displaced by the resilience of the ribs 25*b* according to the rigidity of each paper currency 2 without any fine adjustment. An amount of overlap and frictional force suitable for the delivered paper currency 2 can be obtained by itself. In the past, the material of the gate rollers has been discussed according to the rigidity of the paper currency 2 to be treated, and the amount of overlap has been finely adjusted by positioning.

Because of the structure and operation described thus far, the paper currency collecting-and-delivering device 1 fitted with the gate rollers 25 can deliver and collect various paper currencies 2 having different rigidities and thicknesses. Thus, high-speed processing (delivery and collection) utilizing the overlap method is made possible by the present invention.

Even where hard rubber material is used in the gate rollers 25, a sufficient amount of displacement is obtained. Therefore, the amount of overlap can be set to a large value. Furthermore, since a sufficient amount of displacement is obtained in this way, if the gate rollers 25 are made of highly frictional rubber material, the service life can be prolonged.

Thus, in a second exemplary embodiment of the present invention, the outer peripheral portion 25*a* of each gate roller 25 is made to have a large amount of overlap. The amount of displacement of the outer peripheral portion 25*a* used during delivery is set to a large value. Therefore, if the radius of each gate roller 25 decreases due to wear, the amount of displacement of the outer peripheral portion 25*a* decreases together with decrease in the amount of overlap. In consequence, worn gate rollers 25 can be continued to be used. This dispenses with frequent replacement of the gate rollers 25, i.e., human maintenance is made unnecessary.

The above-described overlap means that the outer peripheries of two rollers are so arranged that they are shifted with respect to each other in the direction of the center axis and that the outer peripheries slightly overlap each other as viewed from the direction of the center axis. Alternatively, plural rollers of the same radius may be combined coaxially to form a roller subassembly as each of the feed roller 31 and gate roller 25. First and second roller subassemblies may be arranged so that the outer peripheries of the roller subassemblies slightly overlap each other.

As shown in FIG. 4B and described above, each feed roller 31 adopts a flexible structure similar to that of the above-described gate rollers 25. The feed roller 31 is cylindrical in shape, and a feed shaft 32, shown in FIG. 1, passes along the center axis. Helical holes extending vertically to the side surface are formed.

The feed roller's outer peripheral portion 31*a* and central portion 31*c* are connected by six ribs 31*b*. The ribs 31*b* are so shaped that their portions closer to the central portion 31*c* are thin and that the ribs thicken gradually toward the outer peripheral portion 31*a*.

The aforementioned ribs 31*b* are each shaped helically, with each rib extending from the central portion 31*c*, to the outer peripheral portion 31*a*. The helical direction for each rib is set to the counterclockwise direction as shown in FIG. 4B. In particular, during operation for delivering paper currencies 2 as shown in FIG. 3, in the presence of load (force received from the conveyance direction x) in carrying the paper currencies 2, the ribs 31*b* opposite to the currencies are pushed and move counterclockwise at the intersection y of the outer peripheral portion 31 a and each currency 2 conveyed in the direction of conveyance x as shown in FIG. 4B.

The outer peripheral portion 31*a*, six ribs 31*b*, and central portion 31*c* are molded integrally from a hard rubber material. The gaps between the ribs 31*b* are shaped into helical cavities 31*d* that gradually thin from the central portion 31*c* toward the outer peripheral portion 31*a*. The helical direction from the central portion 31*c* of each cavity 31*d* toward the outer peripheral portion 31*a* is also set to counterclockwise direction as shown in FIG. 4B in the same way as the ribs 31*b*. That is, during operation for delivering paper currencies 2 as shown in FIG. 3, in the presence of load in carrying the currencies 2 (force received from the direction of conveyance x), the ribs 31*b* opposite to them are pushed in the counterclockwise direction as illustrated in FIGS. 6B and 6C and move back. Each cavity is so shaped as to thin gradually from the central portion 31*c* toward the outer peripheral portion 31*a*.

Because of the structure described thus far, when the feed roller 31 receives the force of load in conveying each currency 2 from the outer periphery toward the center axis, the ribs 31*b* are pushed backward in the portions where the ribs 31*b* opposite to the currency are thinned. The ribs 31*b* are deformed in the counterclockwise direction. The outer peripheral portion 31*a* can be displaced toward the center axis such that the peripheral portion 31*a* itself hardly deforms.

Since the feed roller 31 has a large width, the end of the rib 31*b* on the center axis side does not deform at an angle to the direction of the center axis. The outer peripheral portion 31*a* is displaced straight toward the center axis.

Both rollers 25 and 31 can be made to have a flexible structure by using feed rollers 31 of the flexible structure shown in FIG. 4B as the feed rollers 31 already described in connection with FIGS. 1–3.

In describing the relation between the configuration of this invention and the embodiments described above, the collecting-and-delivering device of this invention corresponds to the collecting-and-delivering device 1 and currency delivery unit of the embodiments. Similarly, sheets of paper correspond to paper currencies 2. Rollers correspond to gate rollers 25 and feed rollers 31. Outer peripheral portions correspond to outer peripheral portions 25*a* and 31*a*. Connector portions correspond to the ribs 25*b*, 31*b* and cavities 25*d* , 31*d*. Furthermore, while exemplary embodiments of the invention have been described and illustrated, various changes and modifications may be made without departing from the spirit or scope of the invention. Accordingly, the invention is not limited by the foregoing description, but is only limited by the scope of the appended claims.

What is claimed as new and desired to be protected by Letters Patent of the United States is:

1. A roller comprising:

a central portion extending along an axis;

an outer peripheral portion consisting of a resilient body around said central portion; and a plurality of helical ribs each made of a resilient body, said ribs connecting together said central portion and said outer peripheral portion.

2. The roller of claim 1, wherein each of said ribs are so shaped as to thicken gradually from said central portion toward said outer peripheral portion.

3. The roller of claim 1, wherein the gaps between said ribs are shaped into helical cavities that gradually thin from said central portion toward said outer peripheral portion.

4. A sheet delivery unit comprising:

feed rollers that rotate and deliver sheets of paper and gate rollers for separating said sheets, wherein a contact surface formed by plural disk-like protrusions is formed on an outer surface of said gate rollers and said feed rollers, and wherein the contact surface of said gate rollers is made to overlap the contact surface of said feed rollers, and wherein at least said feed rollers or said gate rollers are comprised of:

a central portion extending along an axis, an outer peripheral portion consisting of a resilient body around said central portion, a plurality of helical ribs each made of a resilient body, said ribs connecting together said central portion and said outer peripheral portion; and a plurality of cavities formed helically from said central portion toward said outer peripheral portion of said roller.

5. The sheet delivery unit of claim 4, wherein each of said helical ribs is so shaped as to thicken gradually from said central portion toward said outer peripheral portion.

6. The sheet delivery unit of claim 4, wherein said cavities gradually thin from said central portion toward said outer portion.

7. The sheet delivery unit of claim 4, wherein each of said helical ribs of said rollers forms a helix directed counterclockwise from said central portion toward said outer peripheral portion such that a rib is deflected counterclockwise in the presences of a load applied to the outer peripheral portion of said rollers.

* * * * *